US007174575B1

(12) United States Patent
Scherer

(10) Patent No.: US 7,174,575 B1
(45) Date of Patent: Feb. 13, 2007

(54) RATCHET MECHANISM FOR THE HEADBAND OF PROTECTIVE HEADGEAR USED IN HIGH TEMPERATURE ENVIRONMENTS

(75) Inventor: Paul T. Scherer, Lexington, KY (US)

(73) Assignee: E.D. Bullard Company, Cynthiana, KY (US)

( * ) Notice: Subject to any disclaimer, the term of this patent is extended or adjusted under 35 U.S.C. 154(b) by 55 days.

(21) Appl. No.: 11/155,790

(22) Filed: Jun. 17, 2005

Related U.S. Application Data

(63) Continuation-in-part of application No. 10/899,467, filed on Jul. 26, 2004, now Pat. No. 7,000,262, and a continuation-in-part of application No. 10/930,633, filed on Aug. 31, 2004, now Pat. No. 7,043,772.

(51) Int. Cl.
*A42B 1/22* (2006.01)

(52) U.S. Cl. ..... 2/418; 24/68 B

(58) Field of Classification Search ..... 2/417, 2/418, 419, 183, 426, 8.1, DIG. 11; 24/68 B; 74/530
See application file for complete search history.

(56) References Cited

U.S. PATENT DOCUMENTS 2,360,101 A * 10/1944 Bowers ..... 2/8.1
2,511,234 A * 6/1950 Anderson ..... 2/8.1
3,041,622 A * 7/1962 Gurtowski ..... 2/8.1
3,090,046 A * 5/1963 Bowers, Sr. ..... 2/8.1
3,444,560 A * 5/1969 Northup, Jr. ..... 2/8.1
5,950,245 A * 9/1999 Binduga ..... 2/417
6,314,588 B1 * 11/2001 Fang ..... 2/418
2005/0115027 A1 * 6/2005 Hsu ..... 24/3.12

* cited by examiner

*Primary Examiner*—Rodney Lindsey
(74) *Attorney, Agent, or Firm*—Stites & Harbison, PLLC; David W. Nagle, Jr.

(57) ABSTRACT

A ratchet mechanism for the headband of a protective helmet or other headgear is designed to function in high-temperature environments, while still allowing for ready adjustment of the size and fit of the headband. In this regard, the ratchet mechanism includes a rotational element that has a pinion adapted to mate with and engage the respective rack gears of the overlapping rear end portions of the headband, such that rotation of the rotational element causes lateral movement of the overlapping rear end portions with respect to one another. A spring assembly associated with the rotational element engages a ring gear defined by an insert received and retained in the housing so as to resist rotation of the rotational element relative to said housing sections. Since the spring assembly and insert are preferably manufactured from metal, they do not suffer from warping problems, and therefore, the ratchet mechanism continues to function properly even in high-temperature environments.

18 Claims, 9 Drawing Sheets

4/9

RATCHET MECHANISM FOR THE HEADBAND OF PROTECTIVE HEADGEAR USED IN HIGH TEMPERATURE ENVIRONMENTS

CROSS-REFERENCE TO RELATED APPLICATIONS

The present application is a continuation-in-part of U.S. patent application Ser. No. 10/899,467 filed Jul. 26, 2004, now U.S. Pat. No. 7,000,262; and is a continuation-in-part of U.S. patent application Ser. No. 10/930,633 filed Aug. 31, 2004, now U.S. Pat. No. 7,043,772, the entire disclosures of which are incorporated herein by reference.

BACKGROUND OF THE INVENTION

The present invention relates to a ratchet mechanism for the headband of a protective helmet or similar headgear, a mechanism that allows for adjustment of the size and fit of the headband.

Protective helmets are commonly worn in the industrial workplace to prevent or reduce the likelihood of head injuries. The hard hat is the most common and well-recognized protective helmet. A hard hat consists of three primary components—a shell, a headband, and a suspension system—which cooperate to reduce the potential for injury by attenuating some translational energy of the force of an impact to the helmet.

With respect to the construction and protection afforded by a hard hat, the American National Standards Institute ("ANSI") promulgates minimum performance requirements for protective helmets and further classifies helmets based on their ability to reduce the forces of impact and penetration, as well as their ability to protect against high voltage electric shock. See, for example, ANSI Z89.1-1997 (R1998), American National Standard for Industrial Head Protection.

As mentioned above, a hard hat or similar protective helmet is comprised primarily of: a shell, a headband, and a suspension system. These primary hard hat components cooperate to provide the requisite level of protection. The hard hat shell itself causes any force of impact to be spread across the surface area of the shell. The hard hat suspension separates the wearer's head from the shell such that there is an air gap between the shell and the wearer's head that provides for further attenuation of the force of an impact to the shell. Specifically, when an object strikes the shell of the hard hat, the shell itself flexes inward and the straps of the suspension system will stretch. The air gap accommodates the flexing of the shell and stretching of the straps, but, under normal conditions, prevents the wearer's head from contacting the hard hat shell.

Of course, for a hard hat to provide the appropriate level of protection, it must fit snugly on the wearer's head. In this regard, it is common for the headband of a hard hat to be adjustable to provide for such a snug fit. In this regard, a headband typically has one of two common sizing mechanisms, a pin-lock arrangement or a ratchet mechanism. Regardless of the chosen sizing mechanism, the headband is commonly a flexible, one-piece member that has overlapping rear end portions. With a pin-lock mechanism, a first of the rear end portions of the headband is provided with a pin, and the second of the rear end portions is provided with series of holes at spaced intervals. As such, the pin of the first rear end portion can be inserted through one of the holes of the second rear end portion, thus forming a loop of a selected circumference to fit snugly around the wearer's head. With a ratchet mechanism, lateral movement of the overlapping rear end portions of the headband is effectuated through a rack and pinion arrangement or similar gear arrangement.

As one example of a ratchet mechanism, reference is made to U.S. Pat. No. 4,888,831 issued to Oleson, a patent that is incorporated herein by this reference. As described in the '831 patent, a preferred ratchet mechanism is often a rack and pinion arrangement which operates within elongated overlapping slots defined by the rear end portions of the headband, each of said slots defining a series of teeth of a rack gear. The rack and pinion arrangement and the overlapping rear end portions of the headband are housed between a pair of adjoining arc-shaped housing sections which generally conform to the contour of the wearer's head. The rear end portions of the headband are seated for slidable, lateral movement within the arc-shaped housing sections.

Referring still to the '831 patent, and specifically FIG. 3, one preferred rack and pinion arrangement includes five components: (1) an adjusting knob; (2) a first sprocket that is operably secured to the adjusting knob and engages mating gear teeth defined by the outer housing section, the rearward facing of the two housing sections that enclose the headband; (3) a second sprocket that is operably secured to the first sprocket and engages the teeth of the rack gears of the overlapping rear end portions of the headband; (4) a plate or washer interposed between the first and second sprockets; and (5) a spring or similar biasing member interposed between the first sprocket and the plate so as to bias the first sprocket into engagement with the mating gear teeth defined by the outer housing section. The adjusting knob, first sprocket, and the second sprocket all turn together, with clockwise rotation of the adjusting knob tightening the headband, and counterclockwise rotation of the adjusting knob loosening the headband. The interposed plate and spring bias the first sprocket into engagement with the mating gear teeth defined by the outer housing section so that the rear end portions of the headband do not slide or move without appropriate action by the wearer. In other words, since the interposed plate and spring bias the first sprocket into engagement with the mating gear teeth defined by the outer housing section, the position of the rear end portions of the headband is locked absent manipulation of the adjustment knob by the wearer.

For another example of a rack and pinion arrangement, reference is made to U.S. Pat. No. 5,950,245 issued to Binduga. Again, the headband has overlapping rear end portions. Elongated slots are defined by the rear end portions of the headband, with each of said slots defining a series of teeth of a rack gear. As described in the '245 patent with reference to FIGS. 1 and 2, the rack and pinion arrangement preferably includes (1) an adjustment knob with a first end section for providing a grip member suitable for gripping and turning by the wearer and a second end section that is a generally circular cog, the circular cog engaging the teeth of the rack gears defined by the overlapping rear end portions of the headband; (2) a spring assembly integral with or otherwise secured to the adjustment knob; (3) a housing having outer and inner arc-shaped sections that collectively define an internal cavity; and (4) a ring gear assembly fixed within the housing that cooperates with the spring assembly to provide resistance to rotation of adjustment knob. Thus, in practice, rotation of the adjustment knob causes lateral movement of the overlapping rear end portions of the headband relative to one another. However, because the spring assembly has at least one spring tooth projecting radially and adapted for mating with radially projecting teeth of the ring gear assembly, the position of the rear end portions of the headband is essentially locked absent manipulation of the adjustment knob by the wearer.

For yet another example of a rack and pinion arrangement, reference is made to U.S. patent application Ser. No. 10/899,467, now U.S. Pat. No. 7,000,262, which has been incorporated herein by reference. Again, the rack and pinion arrangement and the overlapping rear end portions of the headband are housed between a pair of adjoining arc-shaped housing sections which generally conform to the contour of the wearer's head. The rear end portions of the headband are seated for slidable, lateral movement within the arc-shaped housing sections, again in response to the rotation of an adjustment knob. Furthermore, as described in U.S. patent application Ser. No. 10/899,467, now U.S. Pat. No. 7,000,262, the arc-shaped housing sections have an inherent flexibility that provides for better fit of the headband and increased comfort to the wearer.

However, the rack and pinion arrangements described in the prior art are generally comprised of a number of individual parts, requiring labor-intensive assembly and also increasing the risk of imprecise or flawed operation of the rack and pinion arrangement. For example, the adjustment knob and pinion (also referred to as a sprocket or cog in some of the prior art references) are often separate parts that are assembled together after the shaft of the adjustment knob is passed through the outer housing section. Alternatively, as described in the above-referenced '245 patent, if the adjustment knob and pinion are a unitary part, the outer housing section must be comprised of multiple parts to allow assembly of the components of the rack and pinion arrangement.

Accordingly, U.S. patent application Ser. No. 10/930,633, now U.S. Pat. No. 7,043,772, which has also been incorporated herein by reference, describes a ratchet mechanism for the headband of a protective helmet or other headgear that minimizes the number of components while ensuring precise, reliable operation of the rack and pinion arrangement of the ratchet mechanism. Specifically, the ratchet mechanism also includes a rotational element, which in this case is a unitary body that includes an adjustment knob portion which is positioned on an exterior side of the outer housing section, and a pinion portion which is positioned on an interior side of the outer housing section and within the internal cavity defined by the housing. This rotational element therefore may be characterized as having a unitary construction. In any event, the pinion is adapted to mate with and engage the respective rack gears of the overlapping rear end portions of the headband such that rotation of the pinion causes lateral movement of the overlapping rear end portions with respect to one another.

However, there is a remaining problem associated with such ratchet mechanisms. In high-temperature environments, such as when the protective helmet is part of a firefighter's helmet, the ratchet mechanism may not perform as intended due to warping of the plastic components. Accordingly, there is a need for a ratchet mechanism that can properly function in high-temperature environments while still allowing for ready adjustment of the size and fit of the headband.

SUMMARY OF THE INVENTION

The present invention is a ratchet mechanism for the headband of a protective helmet or other headgear that is designed to function in high-temperature environments, while still allowing for ready adjustment of the size and fit of the headband. In this regard and as described above, a hard hat or similar protective helmet generally includes a substantially rigid shell, a head band, and a suspension comprised of two or more intersecting straps. A ratchet mechanism is then used to adjust the size of the headband, specifically through engagement of a rotational element with rack gears defined by the overlapping rear end portions of the headband to cause lateral movement of the overlapping rear end portions of said headband with respect to one another.

In one exemplary embodiment of the present invention, the ratchet mechanism includes a housing, which is preferably comprised of an outer substantially arc-shaped housing section joined to an inner substantially arc-shaped housing section, thus defining an internal cavity for receiving the overlapping rear end portions of the headband. The ratchet mechanism also includes a rotational element with an adjustment knob portion which is positioned on an exterior side of the outer housing section, and a pinion portion which is positioned within the internal cavity defined by the housing. The pinion is adapted to mate with and engage the respective rack gears of the overlapping rear end portions of the headband, such that rotation of the pinion causes lateral movement of the overlapping rear end portions with respect to one another.

Furthermore, the rotational element is further provided with a spring assembly, which is preferably manufactured from metal. This spring assembly includes a substantially flat plate with a central opening defined therethrough having a geometry adapted to fit over and mate with the pinion of the rotational element. Thus, the spring assembly rotates with the pinion. Furthermore, the plate has first and second lateral edges, with two arch portions extending from and oriented substantially perpendicular to the plate along these lateral edges. Each of the arch portions can be characterized as having a central portion where the respective arch portion is connected to the plate, along with first and second appendages that are integral with and extend from the respective central portions. The distal ends of each of the appendages are bent over and formed into a configuration that allows them to serve as spring teeth.

In this regard, an insert, also preferably manufactured from metal, is received and retained in one of the housing sections. The insert has an inner circumferential surface that defines a ring gear. Accordingly, the spring teeth of the spring assembly extend from each of the arch portions, mating with and engaging the teeth of the ring gear defined by the insert, locking the position of the rotational element, and thus the rear end portions of the headband relative the housing. However, when the adjustment knob and the rotational element are manually turned by a wearer, the spring teeth are forced over the teeth of the ring gear, with the flexion of the arch portions at the joints between the central portions and the respective appendages allowing for such movement of the spring teeth over the teeth of the ring gear. In other words, by imparting a sufficient torque on the rotational element, the wearer can overcome the spring force and effectuate lateral movement of the overlapping rear end portions of the headband relative to one another.

Accordingly, the spring assembly and insert allow for ready adjustment of the size and fit of the headband. However, since these components are preferably manufactured from metal, they do not suffer from the same warping problems associated with prior art plastic constructions, and therefore, the ratchet mechanism continues to function properly even in high-temperature environments. At the same time, the housing sections, the rotational element, and other components can still be made of polypropylene or a similar plastic material, which is important for purposes of flexibility and comfort.

DETAILED DESCRIPTION OF THE INVENTION

The present invention is a ratchet mechanism for the headband of a protective helmet or other headgear that is designed to function in high-temperature environments, while still allowing for ready adjustment of the size and fit of the headband.

Figure 1:
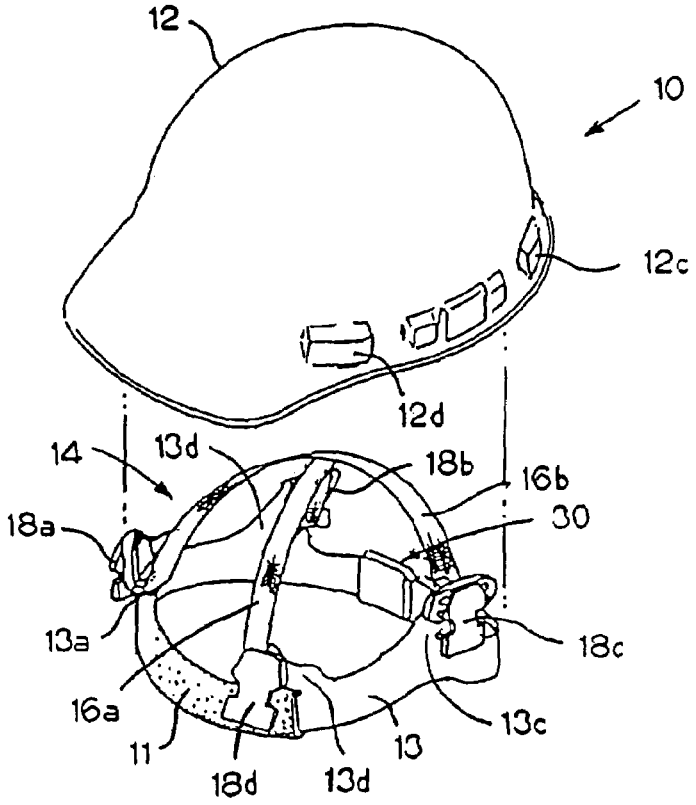
FIG. 1 is an exploded perspective view of a hard hat having an exemplary ratchet mechanism made in accordance with the present invention.

FIG. 1 is an exploded perspective view of an exemplary hard hat 10 that includes a ratchet mechanism made in accordance with the present invention. As shown, this hard hat 10 generally includes: a substantially rigid shell 12 shaped to protect the wearer's head, said shell 12 defining a bottom opening and an internal cavity for receiving the wearer's head; a headband 13 with an absorbent brow pad 11; and a suspension 14. In this exemplary embodiment, the hard hat 10 has a 4-point suspension 14 comprising two intersecting straps 16*a*, 16*b*. A key 18*a*, 18*b*, 18*c*, 18*d* is secured to each end of each of the straps 16*a*, 16*b*. Thus, to secure the suspension 14 to the shell 12 of the hard hat 10, the shell 12 includes four key sockets spaced about the periphery of the shell 12, each such key socket being molded into the shell 12 and adapted to receive one of the keys (generally and collectively indicated by reference numeral 18). In this regard, key sockets 12*c* and 12*d* are illustrated and labeled in FIG. 1. It is contemplated and preferred that the keys 18 be constructed such that they can be "locked" into the key sockets. For further detail regarding one preferred construction of the keys 18 and associated key sockets, reference is made to U.S. Pat. No. 6,609,254, which is incorporated herein by reference.

Figure 2:
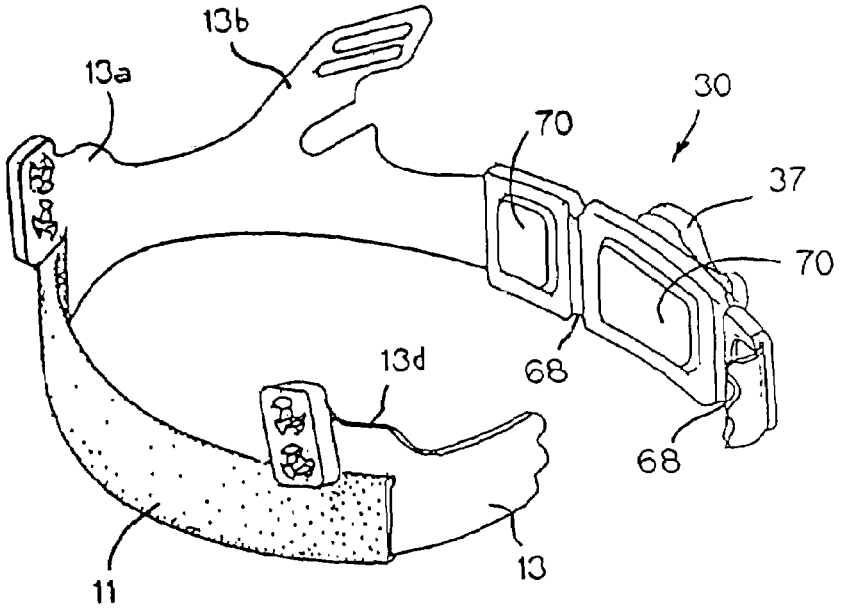
FIG. 2 is an enlarged perspective view of a portion of the headband and associated ratchet mechanism of the hard hat of FIG. 1.

As shown in FIGS. 1 and 2, the headband 13 has a plurality of upwardly extending appendages 13*a*, 13*b*, 13*c*, 13*d*. Each such appendage 13*a*, 13*b*, 13*c*, 13*d* corresponds with a respective key 18*a*, 18*b*, 18*c*, 18*d* of the suspension 14, such that the keys 18 can be secured to the headband 13, completing assembly of the essential components of the hard hat 10.

Nevertheless, the attachment of the headband 13 and suspension straps 16*a*, 16*b* to the shell 12 of the hard hat 10 is not the focus of the present application. Indeed, it is recognized that various attachment means could be employed without departing from the spirit and scope of the present invention. Rather, the present invention relates to a ratchet mechanism for the headband 13 of a hard hat 10 or other protective headgear, as generally indicated by reference numeral 30 in FIGS. 1 and 2.

Figure 3:
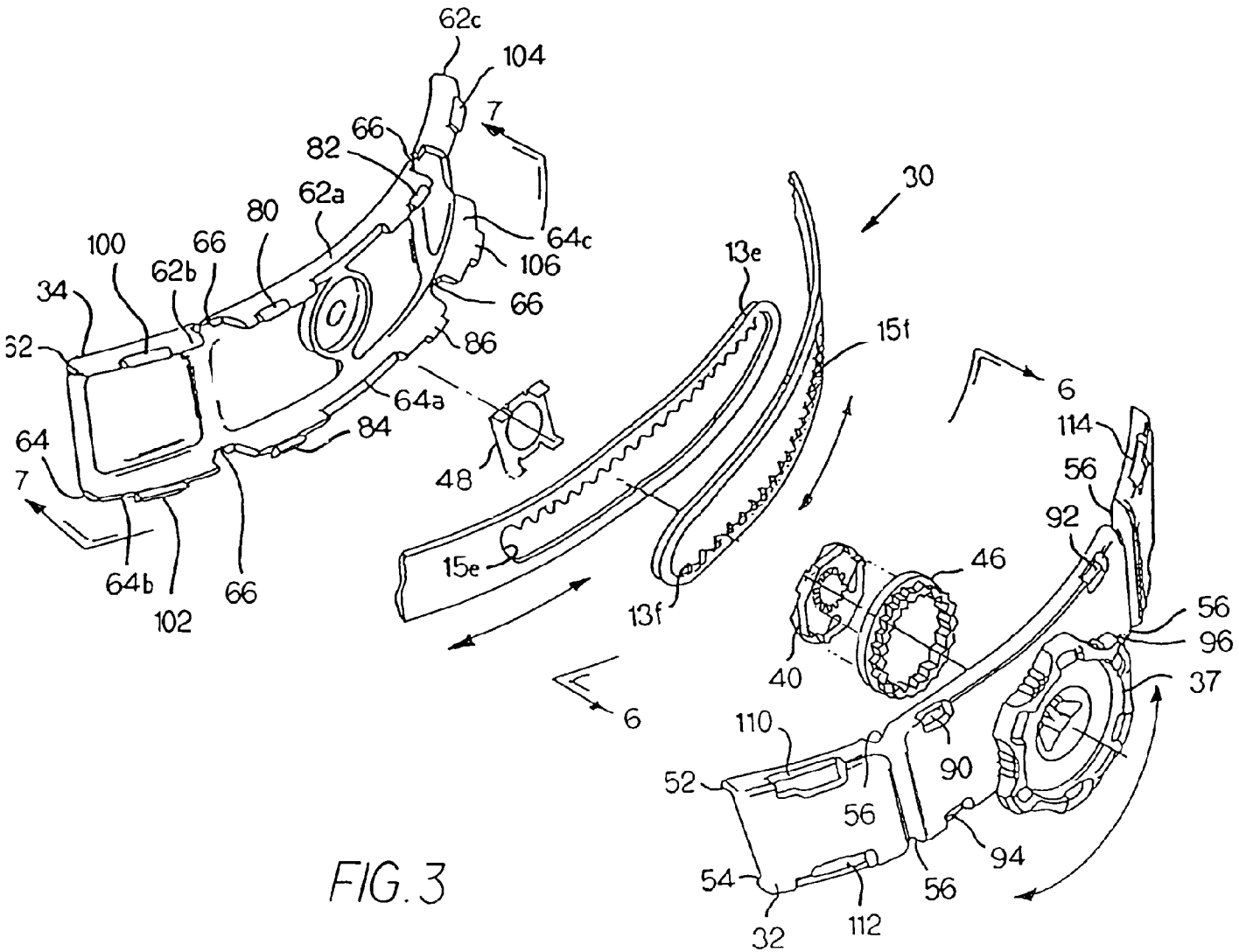
FIG. 3 is an exploded perspective view of the exemplary ratchet mechanism of the hard hat of FIG. 1.

Referring now to FIG. 3, the preferred components of a ratchet mechanism 30 made in accordance with the present invention are illustrated. First, the headband 13 itself has overlapping rear end portions 13*e*, 13*f*. Each of these portions 13*e*, 13*f* preferably defines an elongated slot 15*e*, 15*f* and associated rack gear, the rack gear of one portion 13*e* defined along the upper edge of the slot 15*e*, and the rack gear of the second portion 13*f* defined along the lower edge of the slot 15*f*.

The overlapping rear end portions 13*e*, 13*f* are enclosed in a housing, which is preferably comprised of an outer substantially arc-shaped housing section 32 joined to an inner substantially arc-shaped housing section 34, thus defining an internal cavity for receiving the overlapping rear end portions 13*e*, 13*f* of the headband 13. Each of these housing sections 32, 34 is preferably made of polypropylene or a similar plastic material. The ratchet mechanism 30 also includes a rotational element 36, which in this case is a unitary body that includes an adjustment knob portion 37 which is positioned on an exterior side of the outer housing section 32, and a pinion portion 38 which is positioned on an interior side of the outer housing section 32 and within the internal cavity defined by the housing. This exemplary rotational element 36 therefore may be characterized as having a unitary construction. In any event, the pinion 38 is adapted to mate with and engage the respective rack gears of the overlapping rear end portions 13*e*, 13*f* of the headband 13, such that rotation of the pinion 38 causes lateral movement of the overlapping rear end portions 13*e*, 13*f* with respect to one another.

Figures 6, 6A, 6B:
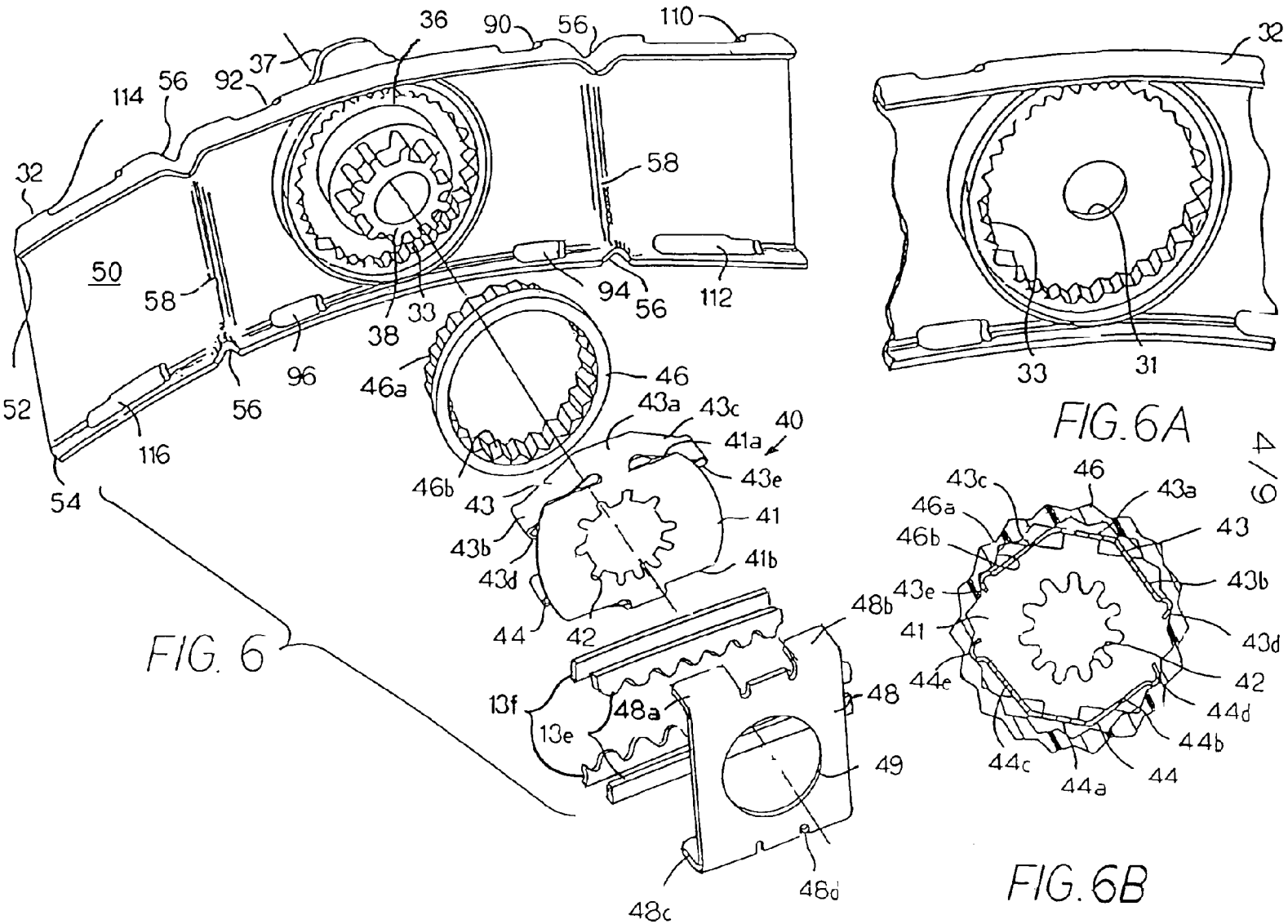
FIG. 6 is an enlarged, exploded perspective view of a portion of the exemplary ratchet mechanism of FIG. 1 taken along line 6—6 of FIG. 3.
FIG. 6A is a perspective view of the outer housing section of the exemplary ratchet mechanism of FIG. 1.
FIG. 6B is an end view of the insert and the spring assembly of the exemplary ratchet mechanism of FIG. 1, illustrating the engagement of the ring assembly with the ring gear defined by the insert.

Furthermore, similar to prior art constructions, the rotational element 36 is further provided with a spring assembly 40. However, unlike prior art constructions, this spring assembly 40 is a separate component manufactured from metal, such as a 075 high carbon steel hardened to about 45 RC. Perhaps as best illustrated in FIGS. 6 and 6B, the spring assembly includes a substantially flat plate 41 with a central opening 42 defined therethrough having a geometry adapted to fit over and mate with the pinion 38 of the rotational element 36. Thus, the spring assembly 40 rotates with the pinion 38. Furthermore, the plate 41 has first and second lateral edges 41*a*, 41*b*, with two arch portions 43, 44 extending from and oriented substantially perpendicular to the plate 41 along these lateral edges 41*a*, 41*b*. In this exemplary embodiment, each of these arch portions 43, 44 is connected to the plate 41 near the center of the respective arch portion 43, 44. Indeed, it is contemplated that the arch portions 43, 44 are integrally formed with the plate 41, with much of the material between the plate 41 and the arch portions 43, 44 being snipped or cut way so that the arch portions 43, 44 can be bent into a substantially perpendicular orientation relative the plate 41.

Referring now to FIG. 6B, each of the arch portions 43, 44 in this exemplary embodiment can be characterized as having a central portion 43*a*, 44*a* where the respective arch portion 43, 44 is connected to the plate 41, along with first and second appendages 43*b*, 44*b*, 43*c*, 44*c* that are integral with and extend from the respective central portions 43*a*, 44*a*. As illustrated, the first and second appendages 43*b*, 44*b*, 43*c*, 44*c* are oriented at an acute angle with respect to the respective central portions 43*a*, 44*a*. Finally, the distal ends of each of the appendages 43*b*, 44*b*, 43*c*, 44*c* are bent over and formed into a configuration that allows them to serve as spring teeth 43*d*, 44*d*, 43*e*, 44*e*, as is further described below.

As best shown in FIG. 6A, and substantially identical to the constructions described in U.S. patent application Ser. Nos. 10/899,467 and 10/930,633, now U.S. Pat. Nos. 7,000,262 and 7,043,772, the outer housing section 32 defines a ring gear 33 that circumscribes an opening 31 through which a shaft portion of the rotational element 36 passes. However, unlike prior constructions, in accordance with the present invention, an insert 46, preferably manufactured from metal (such as an alloyed powdered metal that is hardened to withstand wear), is received and retained in this ring gear 33. Specifically, the metal insert 46 has an outer circumferential surface 46*a* that engages and mates with the ring gear 33 defined by the outer housing section 32, and an inner circumferential surface 46*b* that itself has a geometry defining a ring gear. Of course, because the insert 46 defines the ring gear 46*b* that is necessary for function of the spring assembly 40 (as described below), the ring gear 33 defined by the outer housing 32 serves only as a means by which to secure the insert 46 to the outer housing section 32, and the insert 46 could be secured with respect to the outer housing section 32 in various other manners without departing from the spirit and scope of the present invention.

Figure 4:
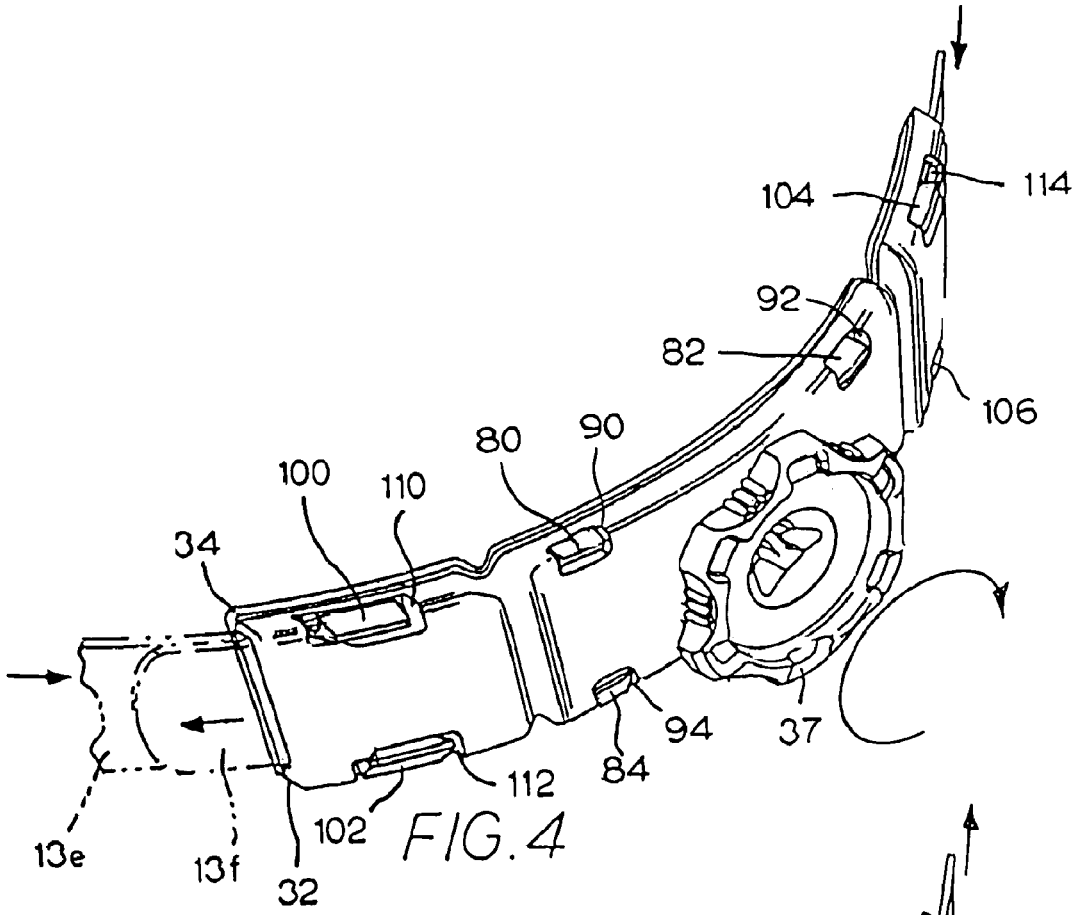
FIG. 4 is a perspective view of the exemplary ratchet mechanism of FIG. 1, illustrating movement of the rear end portions of the headband caused by clockwise rotation of an adjustment knob.
Figure 5:
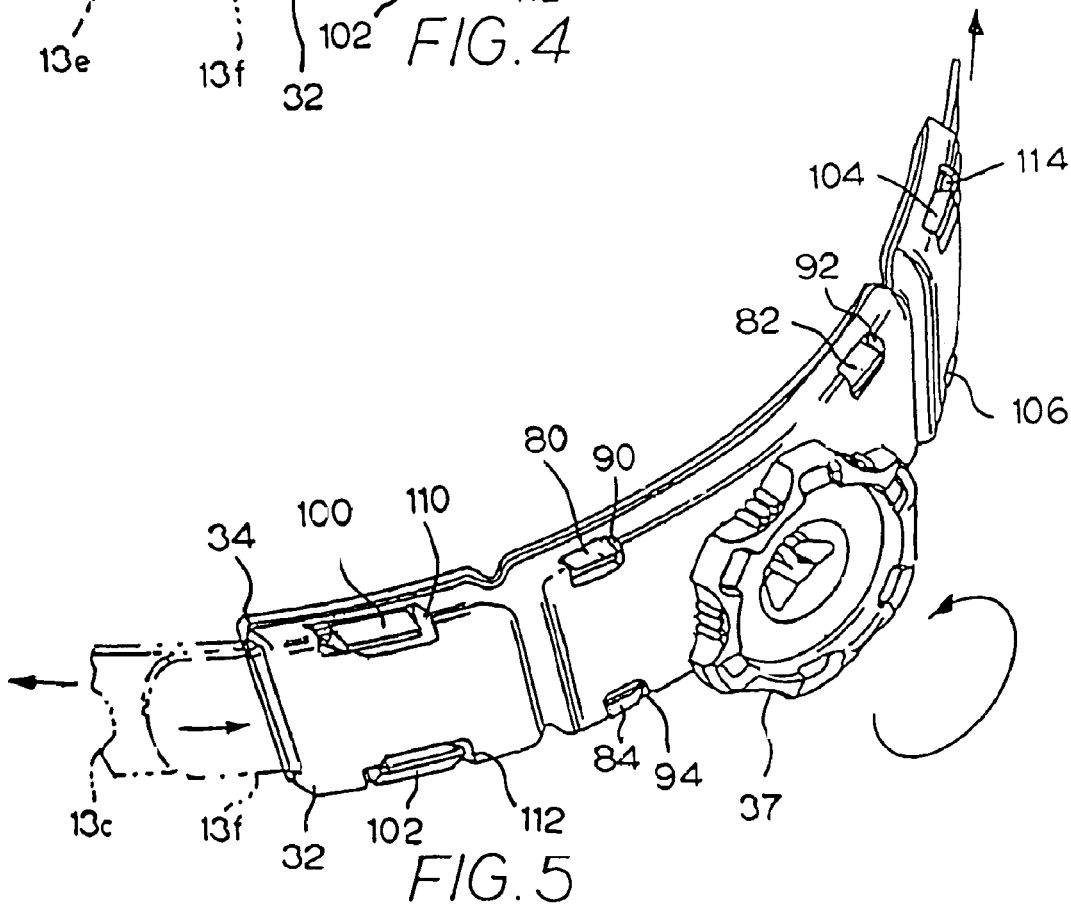
FIG. 5 is a perspective view of the exemplary ratchet mechanism of FIG. 1, illustrating movement of the rear end portions of the headband caused by counterclockwise rotation of the adjustment knob.

The spring teeth 43*d*, 44*d*, 43*e*, 44*e* of the spring assembly 40 extend from each of the arch portions 43, 44, mating with and engaging the teeth of the ring gear 46*b* defined by the insert 46, locking the position of the rotational element 36, and thus the rear end portions 13*e*, 13*f* of the headband 13 relative the outer housing section 32. However, when the adjustment knob 37 and the rotational element 36 are manually turned by a wearer, the spring teeth 43*d*, 44*d*, 43*e*, 44*e* are forced over the teeth of the ring gear 46*b*, with the flexion of the arch portions 43, 44 at the joints between the central portions 43*a*, 44*a* and the respective appendages 43*b*, 44*b*, 43*c*, 44*c* allowing for such movement of the spring teeth 43*d*, 44*d*, 43*e*, 44*e* over the teeth of the ring gear 46*b*. In other words, by imparting a sufficient torque on the rotational element 36, the wearer can overcome the spring force and effectuate lateral movement of the overlapping rear end portions 13*e*, 13*f* of the headband 13 relative to one another. As shown in FIG. 4, clockwise rotation of the adjustment knob 37 moves the rear end portions 13*e*, 13*f* of the headband toward one another, decreasing the circumference of the headband 13. On the other hand, as shown in FIG. 5, counterclockwise rotation of the adjustment knob 37 moves the rear end portions 13*e*, 13*f* of the headband away one another, increasing the circumference of the headband 13. Once the wearer ceases rotation of the adjustment knob 37, the spring teeth 43*d*, 44*d*, 43*e*, 44*e* are restored to engagement with the teeth of the ring gear 46*b*, again locking the position of the rear end portions 13*e*, 13*f* of the headband 13.

Accordingly, as should be clear from the above description, the spring assembly 40 and insert 46 allow for ready adjustment of the size and fit of the headband 13 in a manner similar to prior art constructions. However, these metal components do not suffer from the same warping problems associated with prior art plastic constructions, and therefore, the ratchet mechanism 30 continues to function properly even in high-temperature environments. At the same time, the housing sections 32, 34, the rotational element 36, and other components can still be made of polypropylene or a similar plastic material, which is important for purposes of flexibility and comfort.

Finally, referring again to FIG. 6, in this exemplary embodiment, another component is illustrated—a retaining plate 48 that is used to maintain the engagement of the pinion 38 of the rotational element 36 with the rack gears defined by the rear end portions 13*e*, 13*f* of the headband 13. In this regard, this retaining plate 48 is preferably manufactured from metal, such as a 075 high carbon steel hardened to about 45 RC, and defines a central opening 49 that has a circumference slightly greater than that of the outer circumference of the pinion 38. Accordingly, when assembled, the retaining plate 48 fits over the pinion 38, but does not rotate with the pinion 38. The retaining plate 48 also includes tabs 48*a*, 48, 48*c*, 48*d*, which are integral with and extend from the upper and lower edges of the retaining plate 48. These tabs 48*a*, 48, 48*c*, 48*d* fit over and around the rear end portions 13*e*, 13*f* of the headband 13, thus maintaining the engagement of the pinion 38 with the rack gears defined by the rear end portions 13*e*, 13*f*.

As a further refinement, as described in U.S. patent application Ser. Nos. 10/899,467 and 10/930,633, now U.S. Pat. Nos. 7,000,262 and 7,043,772, the arc-shaped housing sections 32, 24 in this exemplary embodiment have an inherent flexibility that provides for better fit of the headband and increased comfort to the wearer, although such flexibility is immaterial to ability of the ratchet mechanism 30 to function properly in high-temperature environments.

Referring again to FIG. 6, the outer housing section 32 in this exemplary embodiment is substantially segmented into multiple discrete portions such that the outer housing section 32 is flexible along defined boundaries between the discrete portions. Specifically, in this exemplary embodiment, the outer housing section 32 has a broad wall surface 50 with a height that is slightly greater than the width of the rear end portions 13*e*, 13*f* of the headband 13. Shorter walls 52, 54 extend from the upper and lower edges of this broad wall surface 50. In other words, the outer housing section 32 has a substantially C-shaped cross-section. To obtain the desired flexibility, these walls 52, 54 are provided with detents 56 at spaced intervals. Each detent 56 is formed by angled wall portions that meet at a point. Furthermore, it is preferred that these angled wall portions have a thickness that is less than the nominal thickness of the wall 52, 54, creating a weakened area in the walls 52, 54 that causes "collapse" of the walls at the detent 56, creating a precisely located flex point. Then, by connecting each corresponding pair of detents 56 in the upper and lower walls 52, 54 of the outer housing section 32 with a channel or groove 58 in the broad wall surface 50, defined boundaries are created, and the outer housing section 32 is substantially segmented into multiple discrete portions. Thus, the outer housing section 32 is flexible along the defined boundaries between the discrete portions.

Figure 7:
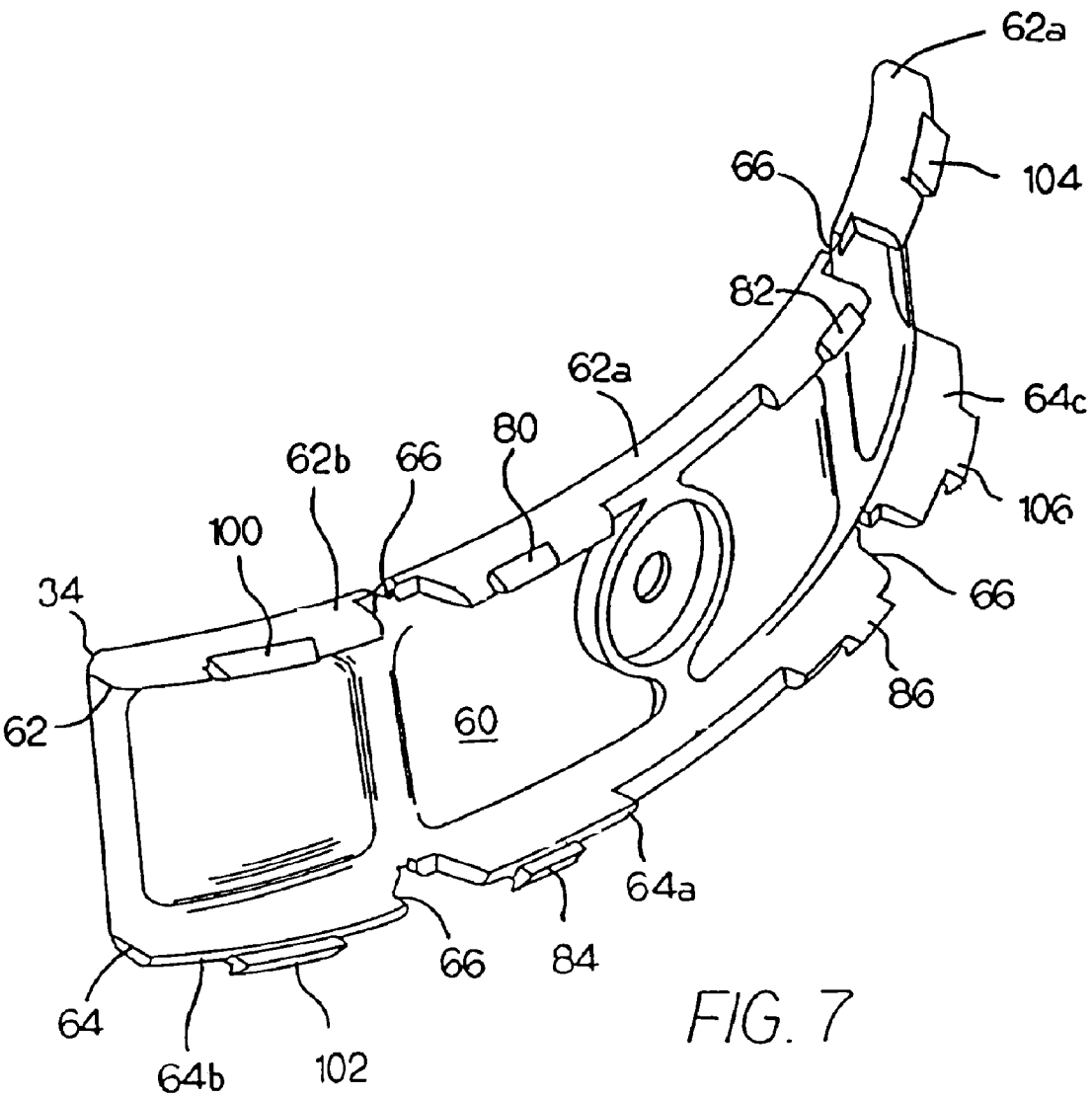
FIG. 7 is a perspective view of the inner housing section of the exemplary ratchet mechanism of FIG. 1 taken along line 7—7 of FIG. 3.

Referring now to FIG. 7, the inner housing section 34 of the ratchet mechanism 30 in this exemplary embodiment is also substantially segmented into multiple discrete portions such that it is flexible along defined boundaries between the discrete portions. Similar to the outer housing section 32, the inner housing section 34 has a broad wall surface 60 with shorter walls 62, 64 that extend from the upper and lower edges of this broad wall surface 60. These upper and lower walls 62, 64 are designed to mate with the corresponding upper and lower walls 50, 52 of the outer housing section 32 to join the two housing sections 32, 34 together, as is further described below. However, rather than be provided with detents, these walls 62, 64 are broken at spaced intervals that correspond with the position of the detents 56 defined in the upper and lower walls 52, 54 of the outer housing section 32. Furthermore, notches 66 are defined in the broad wall surface 60, again to correspond with the position of the detents 56 defined in the upper and lower walls 52, 54 of the outer housing section 32. By connecting each corresponding pair of notches 66 with a channel or groove 68 (as shown in FIG. 2) in the broad wall surface 60, defined boundaries are created, substantially segmenting the inner housing section 34 into multiple discrete portions.

To join the outer housing section 32 and the inner housing section 34, various techniques could be used with departing from the spirit and scope of the present invention. In this exemplary embodiment, the outer and inner housing sections 32, 34 are fastened together in a snap-fit relationship with the shorter walls 62, 64 of the inner housing section 34 fitting inside of and adjacent to the shorter walls 52, 54 of the outer housing section 32. Specifically, referring still to FIG. 7, the center wall segments 62*a*, 64*a* of the inner housing section 34 each include a pair of integral projecting tabs 80, 82, 84, 86, with each such tab extending from a respective wall segment 62*a*, 64*a* in a substantially parallel relationship to the broad wall surface 60. Referring again to FIG. 6, the outer housing section 32 is provided with mating openings 90, 92, 94, 96. As such, when the housing sections 32, 34 are pressed together, the projecting tabs 80, 82, 84, 86 of the inner housing section 34 are received and retained by the mating openings 90, 92, 94, 96 of the outer housing section 32, as generally illustrated in FIGS. 4 and 5, and as will be described in further detail below with reference to FIGS. 8–10.

Furthermore, in this exemplary embodiment, each of the outside wall segments 62*b*, 62*c*, 64*b*, 64*c* of the inner housing section 34 are fastened to the corresponding portions of the walls 52, 54 of the outer housing section 32 using a snap-fit relationship. Specifically, referring again to FIG. 7, the outside wall segments 62*b*, 62*c*, 64*b*, 64*c* each include an integral projecting tab 100, 102, 104, 106, with each such tab extending in a substantially parallel relationship to the broad wall surface 60. Referring again to FIG. 6, the outer housing section 32 is provided with mating openings 110, 112, 114, 116. As such, when the housing sections 32, 34 are pressed together, the projecting tabs 100, 102, 104, 106 of the inner housing section 34 are received and retained by the mating openings 110, 112, 114, 116 of the outer housing section 32, as generally illustrated in FIGS. 4 and 5. Unlike the openings 90, 92, 94, 96 defined through the center portion of the outer housing section 32, however, the outer openings 110, 112, 114, 116 each has a width that is larger than that of the corresponding tab 100, 102, 104, 106. As such, each tab 100, 102, 104, 106 can "ride" or move within the corresponding openings 110, 112, 114, 116. As such, when the ratchet mechanism 30 is flexed along the defined boundaries, the openings 110, 112, 114, 116 allow for some limited movement of the outside segments of the outer and inner housing sections 32, 34 relative to one another, thus compensating for any shearing motion between the outer and inner housing sections 32, 34 when the housing is flexed.

Figure 8:
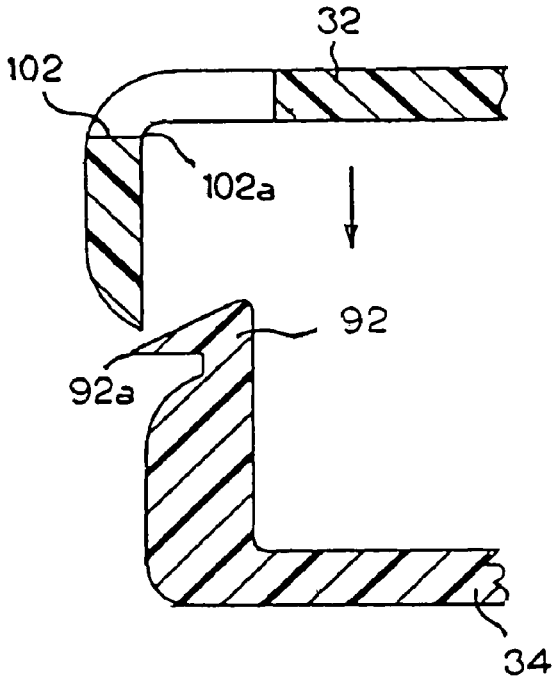
FIGS. 8–10 are sectional views of the inner and outer housing sections of the exemplary ratchet mechanism of FIG. 1, illustrating how the respective housing sections are joined to one another.
Figure 9:
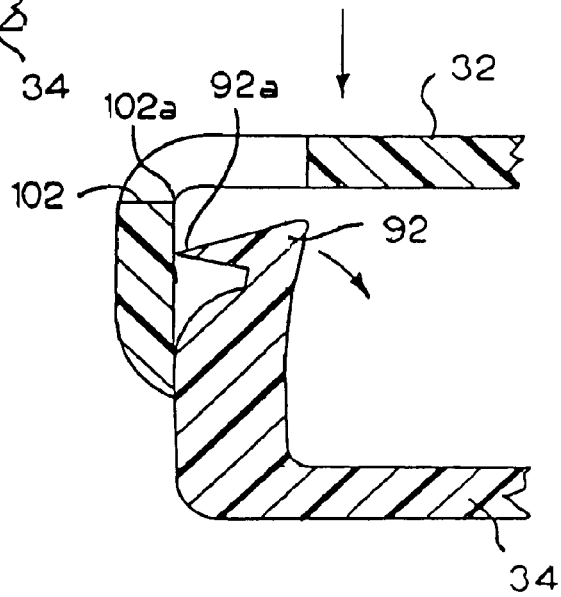
Figure 10:
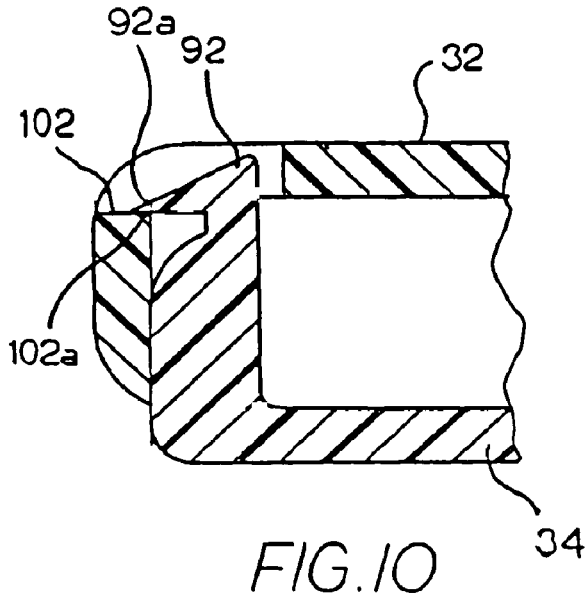

To further explain the snap-fit relationships described above, FIGS. 8–10 are sectional views that illustrate how one projecting tab 92 of the inner housing section 34 is received and retained by an opening 102 of the outer housing section 32. As illustrated in FIGS. 8–10, as the outer section 32 is pressed against the inner housing section 34, the triangular shape of the projecting tab 92 causes it to flex and rotate inwardly. This continues until the tip 92*a* of the tab 92 clears the lip 102*a* of the opening 102. Then, the projecting tab 92 returns to its original, upright position with the tip 92*a* of the tab 92 engaging the lip 102*a* of the opening 102. Each of the other projecting tabs has a similar construction, creating the snap-fit relationship that joins the inner housing section 34 to the outer housing section 32.

Figure 11A:
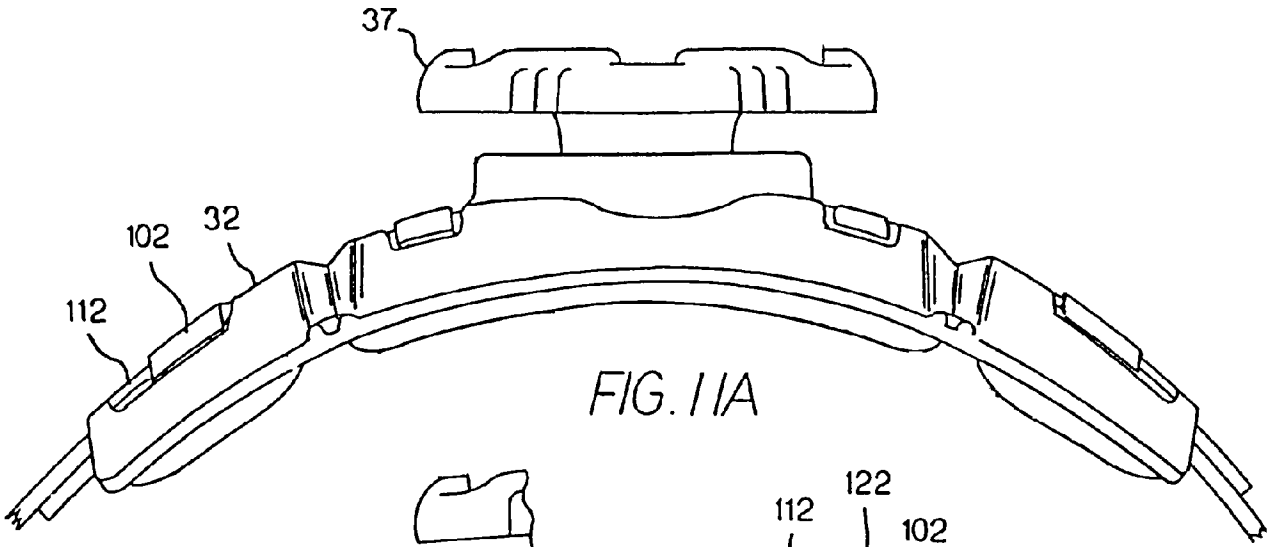
FIG. 11A is a partial side view of the exemplary ratchet mechanism of FIG. 1, illustrating the relationship between an outer tab and a retaining bump when the exemplary ratchet mechanism is in a resting position.
Figure 11B:
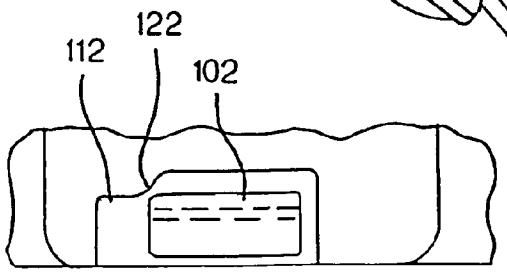
FIG. 11B is a detailed view of the relationship between the outer tab and the retaining bump when the exemplary ratchet mechanism is in the resting position illustrated in FIG. 11A.
Figure 12B:
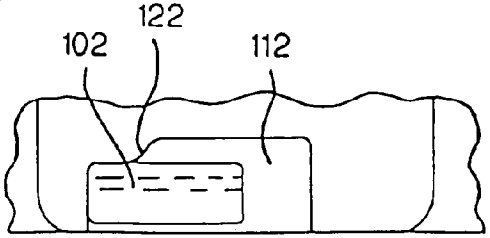
FIG. 12B is a detailed view of the relationship between the outer tab and the retaining bump when the exemplary ratchet mechanism is in the flexed position illustrated in FIG. 12A.
Figure 12A:
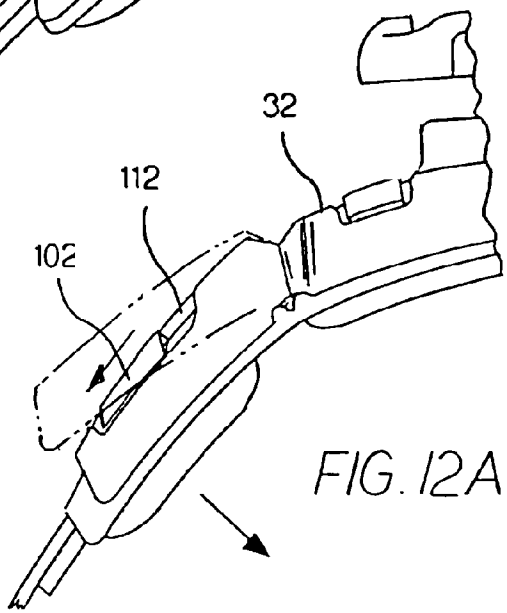
FIG. 12A is a partial side view of the exemplary ratchet mechanism of FIG. 1, illustrating the relationship between an outer tab and a retaining bump when the exemplary ratchet mechanism is in a flexed position.

Finally, as described above, when the ratchet mechanism 30 is flexed inwardly along the defined boundaries, each outer tab 100, 102, 104, 106 will "ride" along the corresponding opening 110, 112, 114, 116 until it reaches the end of that opening 110, 112, 114, 116. The position of the tabs 100, 102, 104, 106 in relation to the openings 110, 112, 114, 116 at this point defines a yield point for the snap-fit function. If the ratchet mechanism 30 is flexed beyond this yield point, the natural reaction is for the tabs 100, 102, 104, 106 to begin to move away from and disengage the lips of the respective openings 110, 112, 114, 116, thus reversing the snap-fit motion illustrated in FIGS. 8–10. In short, the snap-fit would fail. Therefore, as a further refinement to control and prevent failure, each of the openings 110, 112, 114, 116 in this exemplary embodiment includes a retaining bump. On such retaining bump 122 is illustrated in FIGS. 11A, 11B, 12A, and 12B. When the ratchet mechanism 30 is flexed inwardly toward the yield point, the tab 102 will move between the retaining bump 122 and the edge of the opening 112, as illustrated in FIGS. 12A and 12B. If the housing is flexed beyond the yield point, the retaining bump 122 will retain the tab 102 in a locked position relative to the opening 112. In this regard, it should be recognized that the natural or resting position of the ratchet mechanism 30, as illustrated in FIGS. 11A and 11B, is the suggested position when the ratchet mechanism 30 is assembled. This position allows each outer tab 102 adequate clearance from the retaining bump 122, so that the tab 102 can momentarily flex and then "snap" or lock onto the opening 112 as described above with reference to FIGS. 8–10.

Although the exemplary embodiment described above includes arc-shaped housing sections 32, 24 that have an inherent flexibility, the ratchet mechanism is not limited to a construction with such flexibility. Rather, as described above, the focus of the present invention is on the structure that allows the ratchet mechanism 30 function properly in high-temperature environments.

Figure 13:
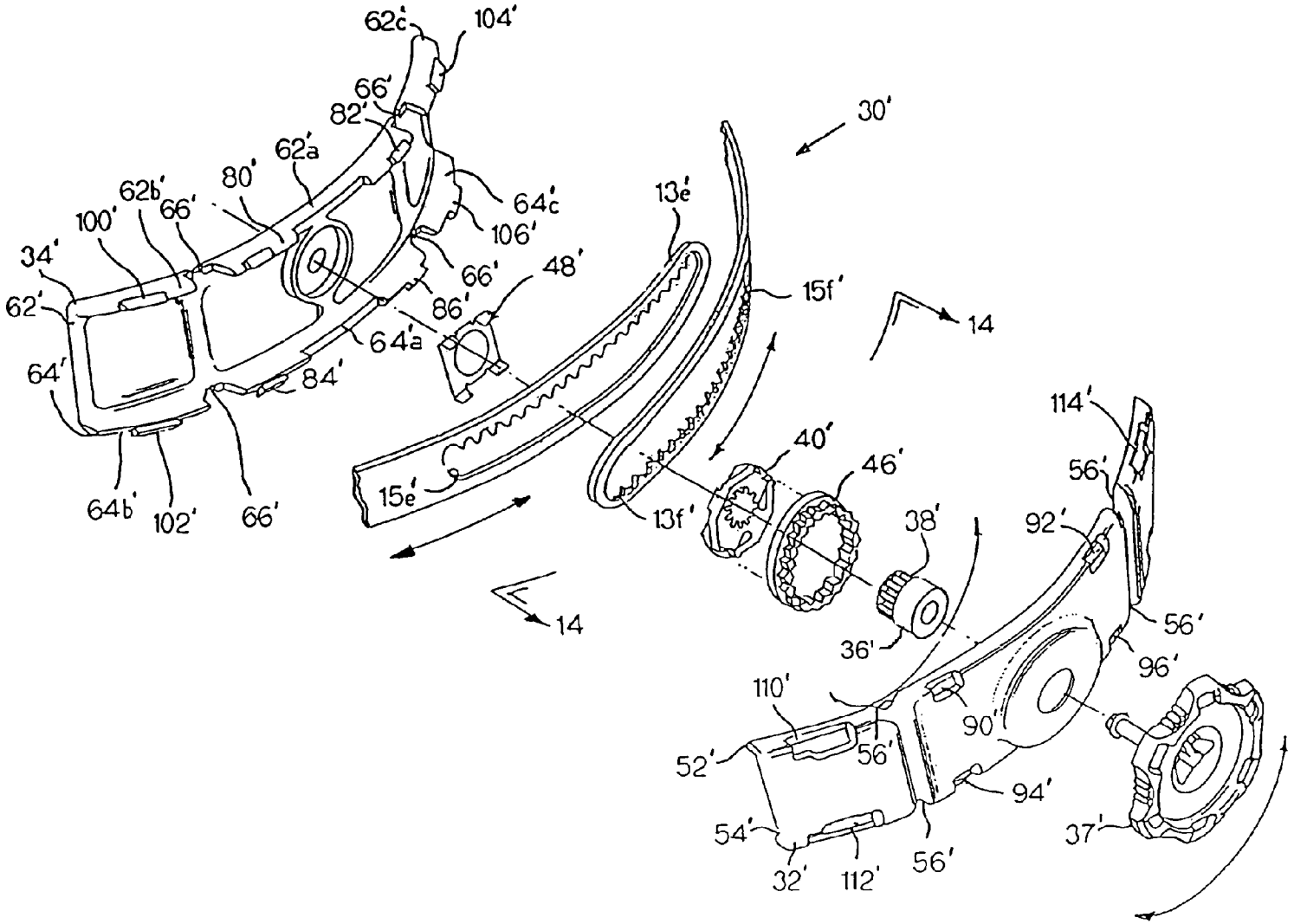
FIG. 13 is an exploded perspective view of an alternate exemplary ratchet mechanism that can be incorporated into the hard hat of FIG. 1.
Figures 14, 14A:
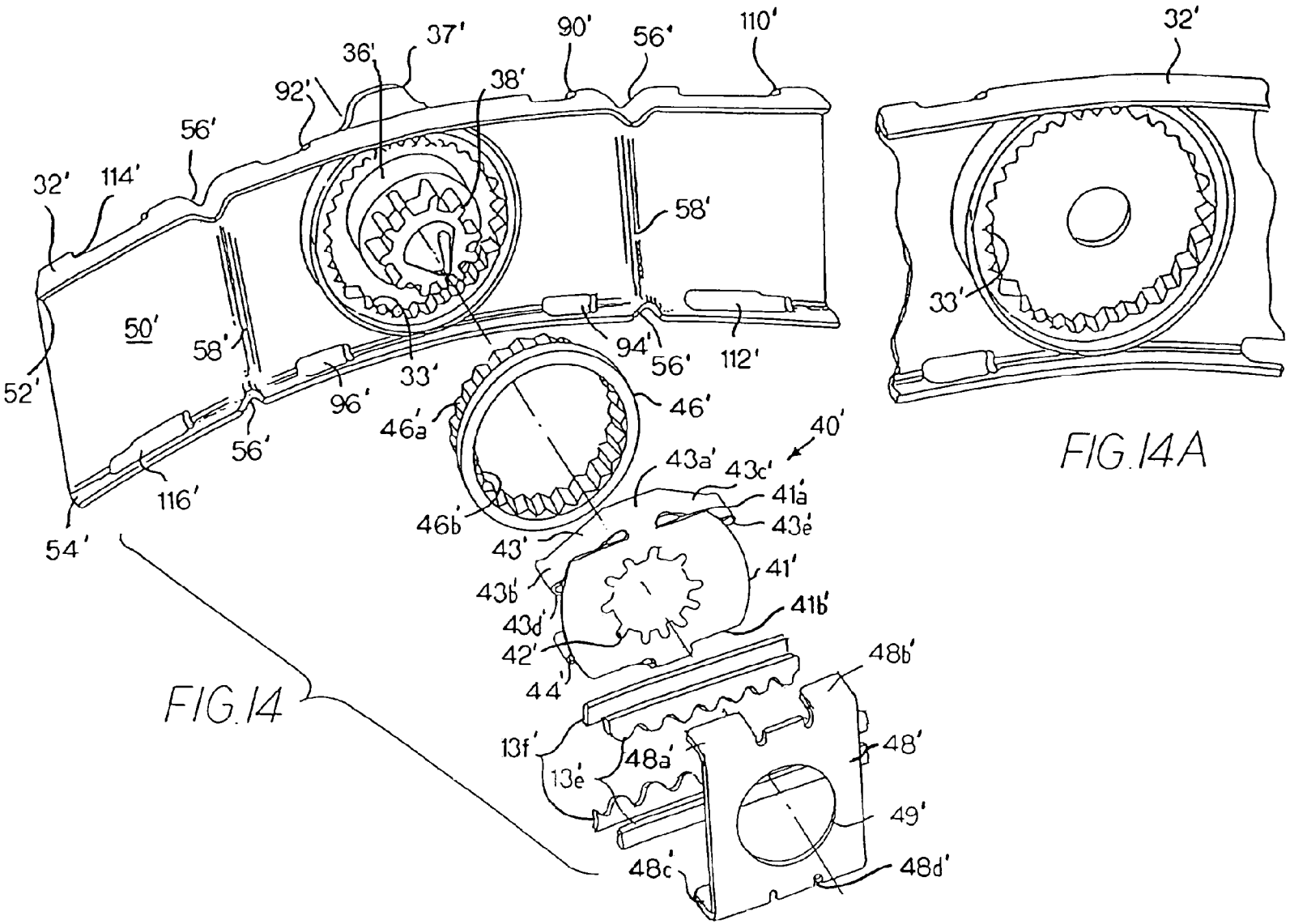
FIG. 14 is an enlarged, exploded perspective view of a portion of the alternate exemplary ratchet mechanism of FIG. 13 taken along line 14—14 of FIG. 13.
FIG. 14A is a perspective view of the outer housing section of the alternate exemplary ratchet mechanism of FIG. 13.

FIGS. 13, 14, and 14A illustrate an alternate exemplary ratchet mechanism 30' that can incorporated into the hard hat of FIG. 1. In this exemplary embodiment, the spring assembly 40', the insert 46', and the retaining plate 48' are the same as found in the embodiment described in corresponding FIGS. 3, 6, 6A, and 6B. Indeed, the only distinction is that the rotational element 36' does not have a unitary construction.

Rather, the rotational element 36' and associated pinion 38' are one component, while the adjustment knob 37' is a separate component, similar to the construction described in U.S. patent application Ser. No. 10/899,467, now U.S. Pat. No. 7,000,262.

One of ordinary skill in the art will also recognize that additional embodiments are possible without departing from the teachings of the present invention or the scope of the claims which follow. This detailed description, and particularly the specific details of the exemplary embodiments disclosed therein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A ratchet mechanism for a headband that has overlapping rear end portions, each rear end portion defining an elongated slot and associated rack gear, comprising:

a housing including an outer substantially arc-shaped housing section joined to a inner substantially arc-shaped housing section, thus defining an internal cavity for receiving the overlapping rear end portions of said headband; and an adjustment mechanism substantially contained within the internal cavity defined by said housing sections and adapted to cause lateral movement of the overlapping rear end portions of said headband with respect to one another, said adjustment mechanism including an insert received and retained in one of said housing sections and having an inner circumferential surface that defines a ring gear, a rotational element contained within the internal cavity defined by said housing sections, said rotational element including a pinion which is adapted to mate with and engage the respective rack gears of the overlapping rear end portions of said headband, an adjustment knob secured to or integral with said rotational element such that rotation of the adjustment knob results in rotation of the rotational element, the pinion of the rotational element engaging the respective rack gears of the overlapping rear end portions of said headband and causing lateral movement of the overlapping rear end portions of said headband with respect to one another, and a spring assembly comprised of a substantially flat plate with a central opening defined therethrough having a geometry adapted to fit over and mate with the pinion of said rotational element, said spring assembly being adapted to engage the ring gear defined by said insert to resist rotation of the rotational element relative to said housing sections.

2. The ratchet mechanism as recited in claim 1, wherein said housing sections are molded from a plastic.

3. The ratchet mechanism as recited in claim 1, wherein said insert and said spring assembly are manufactured from a metal.

4. The ratchet mechanism as recited in claim 2, wherein said insert and said spring assembly are manufactured from a metal.

5. The ratchet mechanism as recited in claim 2, wherein said rotational element and said adjustment knob have a unitary construction.

6. The ratchet mechanism as recited in claim 5, wherein the outer housing section defines an opening therethrough, the rotational element being molded through said opening with the adjustment knob and the pinion positioned on opposite sides of the outer housing section.

7. The ratchet mechanism as recited in claim 2, wherein the outer housing section is substantially segmented into multiple discrete portions such that the outer housing section is flexible along defined boundaries between such discrete portions, and wherein the inner housing section is similarly and substantially segmented into corresponding discrete portions such that the inner housing section is also flexible along defined boundaries between such discrete portions, such that, when the outer and inner housing sections are joined, the housing of the ratchet mechanism has a flexibility that allows it to conform to the head shape of a wearer.

8. The ratchet mechanism as recited in claim 1, wherein said spring assembly further comprises at least two arch portions extending from and oriented substantially perpendicular to the plate along lateral edges thereof, each of these arch portions being connected to the plate near the center of each arch portion, and each of these arch portions engaging the ring gear defined by said insert to resist rotation of the rotational element relative to said housing sections.

9. The ratchet mechanism as recited in claim 8, wherein each said arch portion can be characterized as having a central portion where it is connected to the plate, along with first and second appendages that are integral with and extend from the respective central portions, each of said appendages terminating in a distal end that serves as a spring tooth for engaging the ring gear defined by said insert.

10. The ratchet mechanism as recited in claim 9, wherein when the rotational element is rotated, the spring teeth are forced over the teeth of the ring gear defined by said insert, with the flexion of the arch portions at joints between the central portions and the respective appendages allowing for such movement of the spring teeth over the teeth of the ring gear.

11. The ratchet mechanism as recited in claim 1, and further comprising a retaining plate for maintaining the engagement of the pinion with the respective rack gears of the overlapping rear end portions of said headband, said retaining plate defining a central opening that has a circumference slightly greater than that of the outer circumference of the pinion, such that said retaining plate fits over the pinion, but does not rotate with the pinion.

12. The ratchet mechanism as recited in claim 11, wherein said retaining plate further includes tabs extending from the upper and lower edges thereof, said tabs fitting over and around the overlapping rear end portions of the headband.

13. In combination with an article of protective headgear with an internal suspension, a ratchet mechanism for an adjustable headband with overlapping rear end portions that each define an elongated slot and associated rack gear, comprising:

a molded plastic housing including an outer substantially arc-shaped housing section joined to a inner substantially arc-shaped housing section, thus defining an internal cavity for receiving overlapping rear end portions of said headband and allowing for lateral movement of the overlapping rear end portions of said headband with respect to one another within said internal cavity; and a means for selectively adjusting and maintaining a desired overlap of the overlapping rear end portions of said headband, including:

a metal insert received and retained in one of said housing sections and having an inner circumferential surface that defines a ring gear, a rotational element contained within the internal cavity defined by said housing sections, said rotational element including a pinion which is adapted to mate with and engage the respective rack gears of the overlapping rear end portions of said headband, an adjustment knob secured to or integral with said rotational element such that rotation of the adjustment knob results in rotation of the rotational element, the pinion of the rotational element engaging the respective rack gears of the overlapping rear end portions of said headband and causing lateral movement of the overlapping rear end portions of said headband with respect to one another, and a metal spring assembly comprised of a substantially flat plate with a central opening defined therethrough having a geometry adapted to fit over and mate with the pinion of said rotational element, said spring assembly being adapted to engage the ring gear defined by said metal insert to resist rotation of the rotational element relative to said housing sections.

14. The ratchet mechanism as recited in claim 13, wherein said spring assembly further comprises at least two arch portions extending from and oriented substantially perpendicular to the plate along lateral edges thereof, each of these arch portions being connected to the plate near the center of each arch portion, and each of these arch portions engaging the ring gear defined by said metal insert to resist rotation of the rotational element relative to said housing sections.

15. The ratchet mechanism as recited in claim 14, wherein each said arch portion can be characterized as having a central portion where it is connected to the plate, along with first and second appendages that are integral with and extend from the respective central portions, each of said appendages terminating in a distal end that serves as a spring tooth for engaging the ring gear defined by said metal insert.

16. The ratchet mechanism as recited in claim 15, wherein when the rotational element is rotated, the spring teeth are forced over the teeth of the ring gear defined by said metal insert, with the flexion of the arch portions at joints between the central portions and the respective appendages allowing for such movement of the spring teeth over the teeth of the ring gear.

17. The ratchet mechanism as recited in claim 13, and further comprising a retaining plate for maintaining the engagement of the pinion with the respective rack gears of the overlapping rear end portions of said headband, said retaining plate defining a central opening that has a circumference slightly greater than that of the outer circumference of the pinion, such that said retaining plate fits over the pinion, but does not rotate with the pinion.

18. The ratchet mechanism as recited in claim 17, wherein said retaining plate further includes tabs extending from the upper and lower edges thereof, said tabs fitting over and around the overlapping rear end portions of the headband.

* * * * *